United States Patent [19]

Armbruster et al.

[11] 4,242,839

[45] Jan. 6, 1981

[54] HIGH-SPEED POWER TOOL

[75] Inventors: Gerhard Armbruster, Stuttgart-Plieningen; Albert Kleider, Waldenbuch; Eberhard Vogel, Dettenhausen, all of Fed. Rep. of Germany

[73] Assignee: Robert Bosch GmbH, Stuttgart, Fed. Rep. of Germany

[21] Appl. No.: 954,630

[22] Filed: Oct. 23, 1978

Related U.S. Application Data

[63] Continuation of Ser. No. 797,503, May 16, 1977, abandoned, which is a continuation of Ser. No. 624,105, Oct. 20, 1975, abandoned.

[30] Foreign Application Priority Data

Nov. 2, 1974 [DE] Fed. Rep. of Germany ... 7436615[U]

[51] Int. Cl.[3] ..... B24B 23/00

[52] U.S. Cl. ..... 51/170 MT

[58] Field of Search ..... 51/170 MT, 170 TL, 170 R; 74/230.16, 230.11, 230.03, 230.13; 308/18

[56] References Cited

U.S. PATENT DOCUMENTS

| | | | |
|---|---|---|---|
| 148,968 | 3/1874 | Margedant | 74/230.18 |
| 327,120 | 9/1885 | Thompson | 74/230.16 |
| 2,764,852 | 10/1956 | Emmons | 51/170 MT |
| 3,199,251 | 8/1965 | Enders | 51/170 MT |
| 3,345,784 | 10/1967 | Stelljes | 51/170 MT |
| 3,371,451 | 3/1968 | Enders | 51/170 MT |
| 3,418,761 | 12/1968 | Sheps | 51/170 R |

FOREIGN PATENT DOCUMENTS

| | | | |
|---|---|---|---|
| 494745 | 3/1954 | Italy | 51/170 MT |
| 1235789 | 6/1971 | United Kingdom | 51/170 MT |

*Primary Examiner*—Nicholas P. Godici
*Assistant Examiner*—Roscoe V. Parker
*Attorney, Agent, or Firm*—Michael J. Striker

[57] ABSTRACT

A high-speed power tool has a housing for an electromotor, and a tool casing mounted on the motor housing. A finishing plate is mounted on the tool casing for movement relative thereto. The motor drives a transmission which includes a crank member having an eccentric portion connected to the finishing plate for imparting oscillatory motion to the latter. The arrangement for connecting the eccentric portion of the crank member to the finishing plate includes a bearing mounted on the eccentric portion of the crank member, and a sleeve surrounding the bearing and detachably connected to the finishing plate. Screws which are accessible from the exterior of the tool casing and of the finishing plate connect the sleeve to the finishing plate. The transmission includes two pulleys mounted on the output shaft of the electromotor and on the crank member, respectively, the pulley on the output shaft being bipartite, the two parts of the pulley being spaced by an interchangeable washer and urged toward one another by a screw so that tension of a V-belt trained about the pulleys can be adjusted.

13 Claims, 2 Drawing Figures

HIGH-SPEED POWER TOOL

This is a continuation of application Ser. No. 797,503, filed May 16, 1977, now abandoned, which in turn was a continuation of application Ser. No. 624,105, filed Oct. 20, 1975, now abandoned.

BACKGROUND OF THE INVENTION

The present invention relates to a power tool, and more particularly to a high-speed power tool in which a tool is mounted on a housing for displacement relative thereto, and in which a motor drives the tool in oscillatory motion by a transmission including a crank member.

A wide variety of power tools in which the tool oscillates relative to the housing accommodating the driving motor is already known. Such tools usually utilize a crank member, such as an eccentric, for imparting oscillatory motion to the tool proper. Examples of power tools in which this concept is utilized are oscillating sanders, finishing or superfinishing tools, honing machines and similar devices. Depending on the intended use, the power tool may assume various configurations, and the tool element may also have different shapes. The invention will be presently discussed as utilized in a finishing tool, but it will be appreciated that the particular shapes of the power tool housing and of the tool element, as well as the uses to which the power tool is put may vary in a wide range.

Finishing tools of different constructions are already known. Basically, they may be classified as either low-speed finishing tools in which a finishing tool, such as a finishing plate, conducts 4 to 5 thousand oscillations per minute, and high-speed finishing tools in which the finishing plate conducts 6,000 or more oscillations per minute. High-speed finishing tools have smaller amplitudes of oscillation than low-speed finishing tools, which results in a better quality of the finished surface.

While the finishing plate of any of the heretofore known low-speed finishing tools is driven by the motor via a transmission interposed between the output shaft of the motor and the crank member, some of the high-speed finishing tools have the crank member driven by a transmission, while other high-speed finishing tools employ the motor to directly drive the crank member or even have the output shaft shaped as a crank shaft. In the latter case, the finishing tool has a particularly simple construction; on the other hand, however, this construction is also disadvantageous in that the driving motor utilized therein has considerable dimensions and weight.

All high-speed finishing tools have a drawback that a bearing which transmits the orbiting movement of the eccentric portion of the crank member to the finishing tool plate, has a significantly reduced lifespan as compared to a similar bearing utilized in a low-speed finishing tool. The lifespan of this bearing is dependent only on the speed of oscillation of the finishing plate, and is independent of the fact whether or not a transmission is interposed between the crank member and the driving motor.

The prior art high-speed finishing tools of this type have the drawback that it is very difficult to exchange a worn-out bearing interposed between the eccentric part of the crank member and the finishing plate. This is partially attributable to the fact that, when the bearing is to be exchanged, adhesively connected sealing locations are to be separated and then, when the new bearing is installed, these sealing locations have to be adhesively connected again. These operations are rather laborious and time-consuming, and can only be performed by skilled personnel using special tools and devices.

SUMMARY OF THE INVENTION

Accordingly, it is an object of the present invention to avoid the disadvantages of the prior art.

More particularly, it is an object of the present invention to provide a high-speed finishing tool which is simple in construction and reliable in operation.

It is yet another object of the present invention to so construct a high-speed finishing tool that the bearing interposed between the eccentric portion of the crank member and the finishing tool can be easily replaced.

It is still another object of the present invention to so construct the finishing tool that the exchange of the bearing can be performed by unskilled personnel.

It is a concomitant object of the present invention to provide a high-speed finishing tool in which all of the easily damaged or worn out parts can be easily exchanged.

In pursuance of these objects and others which will become apparent hereinafter, one feature of the present invention resides, in a device of the character described, in a combination which comprises a housing and at least one component mounted at the housing for movement relative thereto. At least one crank member which has a first portion mounted in the housing for rotation about a rotation axis, and a second portion which is connected to the first portion and has an eccentric axis parallel to and radially offset from the rotation axis is driven in rotation by a driving motor in such a manner that the second portion conducts eccentric motion about the rotation axis. An arrangement is provided which converts the eccentric motion of the second portion into oscillation of the component, this arrangement including a sleeve which at least partially surrounds the second portion of the crank member and which is detachably connected to the component, and a bearing interposed between the sleeve and the second portion of the crank member which is operative for transmitting forces from the second portion to the sleeve.

The sleeve is arranged at the major surface of the finishing plate which faces toward the housing, and screws extend through the plate from one of the major surfaces to the other one and are threadedly connected to the sleeve so as to attach it to the plate. In this manner, the finishing plate can be easily removed from the housing and the bearing can be easily replaced.

According to a currently preferred embodiment of the present invention, the sleeve is connected to the finishing plate by three screws extending through the finishing place so as to be accessible from the exterior of the housing and of the finishing plate. An annular projection may be provided at the major surface of the plate which faces toward the housing, which annular projection defines a depression in which the sleeve may be fittingly received. In this manner, the radially directed forces resulting from the eccentric movement of the eccentric portion of the crank member are transmitted to and counteracted by the annular projection so that the screws which attach the sleeve to the finishing plate are not subjected to shearing forces.

In a currently prefered embodiment of the present invention, the crank member is driven into rotation about its rotation axis via a belt transmission, particularly a V-belt transmission in which two pulleys are arranged at the output shaft of the driving motor and on the crank member, respectively, for shared rotation therewith. A V-belt is trained about the pulleys and transmits a driving force to the crank member. The pulley associated with the crank member may be provided with a counterweight for counteracting the effects of eccentricity of the crank member, and the pulley associated with the output shaft of the motor may be of a bipartite construction and can be disassembled in a simple manner at the same time as and similarly to the exchange of the bearing.

In this connection, it has also been found to be advantageous when the two parts of the pulley associated with the output shaft of the motor are of an annular configuration each, and it is also currently preferred that the annular portion of the pulley which is more spaced from the motor than the other annular portion is connected to the output shaft of the motor only by one screw. In this manner, the V-belt may be removed from the pulley associated with the output shaft of the motor in a rather simple way and replaced by a new V-belt. It is also advantageous if the spacing between the two portions of the pulley associated with the output shaft of the motor is determined by an interchangeable washer or a similar disc-shaped element interposed between the two pulley portions, whereby the tension of the belt may be selected by utilizing a disc-shaped member of the proper thickness.

The fact that the bearing, such as a ball bearing, is received in a sleeve which is detachably connected to the finishing plate by screws and which is manufactured separately of the finishing plate, renders it possible as a further advantage of the present invention to make the finishing plate of a material which has a relatively low specific weight, while the sleeve may be made of a material which has a substantially higher specific weight, which contributes to a better balancing of the crank drive. It has been found to be advantageous if the finishing plate is made of a light metal and the sleeve is made of steel.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
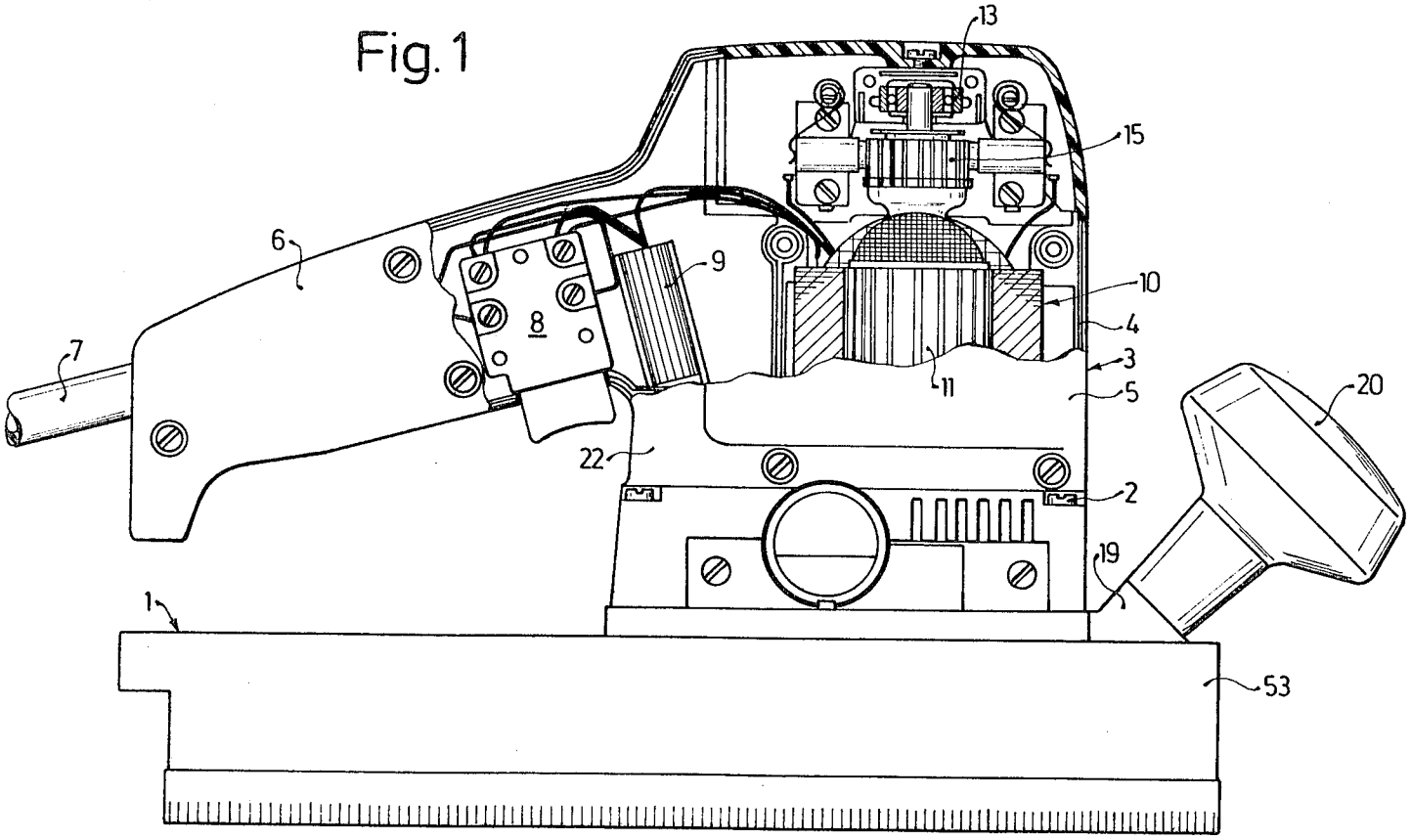
FIG. 1 is a partially sectioned side elevational view of the finishing tool of the present invention.
Figure 2:
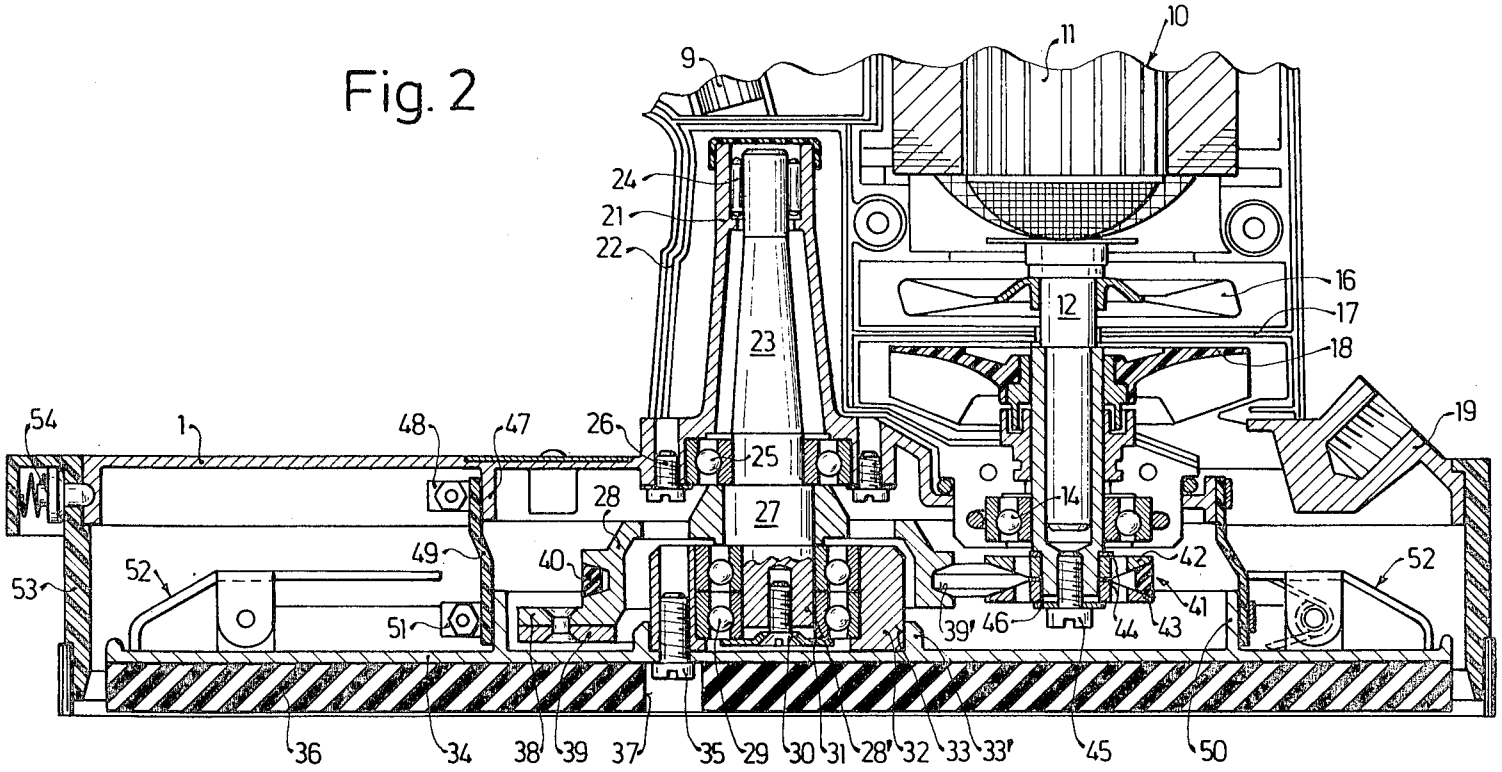
FIG. 2 is a sectioned side elevational view of a part of the finishing tool at a larger scale.

Referring now to the drawings in detail, it may be seen that the present invention is illustrated as embodied in an oscillating power tool, such as a finishing tool. However, it is to be understood that the present invention is capable of being used also in other oscillatory devices.

The power tool of the present invention includes a driving motor housing 3 on which there is mounted a finishing tool casing 1 by means of screws 2. The housing 3 includes two shells 4 and 5 which are connected to one another. In the following description, reference will be had to upward and downward, as well as lateral directions, and these directions are to be understood to relate to the power tool as illustrated in the drawing. So, for instance, the downward direction is toward the casing 1, while the upward direction extends toward the housing 3.

A handle 6 is connected to the housing and extends laterally thereof, and an input cable 7 passes through the handle 6. In the illustrated embodiment, an electromotor 10 is accommodated in the housing, and a switch 8 and an interference suppressing capacitor 9 are arranged between the cable 7 and the motor 10. The motor 10 has a rotor 11 which is connected to an output shaft 12 for shared rotation therewith, the shaft 12 extending downwardly of the motor 10. The output shaft is mounted in the housing 3 by bearings 13 for the upper end of the output shaft 12, and 14 for the lower end of the output shaft 12.

The following parts are arranged on the output shaft 12 in direction from above to below: a collector ring 15, the rotor 11, a ventilator 16 for the motor, and, below a partition wall 17, a particulate material withdrawing ventilator 18.

In the region of the motor housing 3, there is provided at the upper part of the finishing casing 1 a projection 19 which extends in an opposite direction than the handle 6, a second handle 20 being threadedly connected to the projection 19. A bearing supporting element 21 is provided below the handle 6 at the outer side of the finishing casing 1, which has approximately the shape of a hollow truncated cone. This support element 21 is surrounded by a part 22 of the motor housing 3 and thus concealed from view. A crank member 23 is supported in the bearing support 21, the crank member 23 being supported in the narrower upper part of the bearing support 21 by means of a needle bearing 24, and in the lower wider part in a ball bearing 25. The needle bearing 24 is arranged on the crank member 23 from above and the ball bearing 25 from below. The ball bearing 25 is held in its proper position by means of screws 26. Underneath the seat for the ball bearing 25 the crank member 23 is formed with a seat 27 for a first integrally constructed V-belt pulley 28. Underneath the seat 27, the crank member 23 has an eccentric portion in form of a crank pin 28', and a two-row ball bearing 29 is seated on the crank pin 28'. The ball bearing 29 is attached to the crank pin 28' by means of a screw 30, a washer 31 being interposed between the screw 30 and the crank pin 28'.

The outer race of the ball bearing 29 is fittingly received in a sleeve 32 of a hollow cylindrical configuration, made of steel. A finishing plate 34 is made of light metal and formed with an annular projection 33' which bounds a depression 33 in which the sleeve 32 is fittingly received. Three screws 35 extend through the finishing plate 34 and connect the sleeve 32 to the same. The finishing plate 34 carries at its lower part a rubber plate 36 which is adhesively connected thereto, the rubber plate 36 being formed with holes 37 in the region of the screws 35, the heads of the screws 35 being accessible from the exterior of the housing 3 and of the casing 1 through the holes 37.

The integral V-belt pulley 28 has a bell-shaped configuration and surrounds the sleeve 32. The pulley 28 carries on its lower side, immediately adjacent the finishing plate 34 and extending oppositely to the crank pin 28'. a counterweight 38 integral with the pulley 28 and reinforced by an additional weight 39 of a heavier metal which is riveted thereto. The pulley 28 is formed with a recess 39'' in which a V-belt 40 is received.

A second bipartite V-belt pulley 41 is arranged at the level of the recess 39' at the output shaft 12, the pulley 41 including an upper part 42 and a lower part 43, each of a disc-shaped configuration. An interchangeable spacing disc 44 is located between the parts 42 and 43 of the pulley 41 whereby the spacing of the parts 42 and 43 relative to one another and to the output shaft 12 can be adjusted. A screw 45 is threaded from below into the output shaft 12 of the motor 10 and attaches via an interposed washer 46, the bipartite V-belt pulley 41 to the output shaft 12.

The finishing casing 1 has a downwardly extending flange 47 to which a jacket 49 of a hollow cylindrical configuration and made of an elastically yieldable material is connected at its upper end by means of a first shell 48. A similar flange 50 is provided at the finishing plate 34 and extends upwardly therefrom and a second shell 51 connects the lower margin of the jacket 49 thereto.

To clamping arrangements 52 are arranged at the upper major surface of the finishing plate 34, which serves the purpose of connecting a piece of sheet-shaped finishing material to the finishing plate 34.

An exhaust frame 53 is connected to the finishing casing 1 by means of a connecting arrangement 54 of the snap-action type, the exhaust frame 53 surrounding the finishing plate 34 with the clamping arrangement 52 and the jacket 49 and concealing the same from view. The purpose of this exhaust frame 53 is to guide the air stream generated by the ventilator 18 so as to conduct the particulate material severed from the article being finished to the ventilator 18 which then advances the particulate material into a non-illustrated, because conventional, collecting receptacle.

Having so described the construction of the finishing power tool of the present invention, the advantages thereof will now be briefly discussed. One of the main advantages is that a worn out or damaged ball bearing 29 can be easily replaced in such a manner, that the exhaust frame 53 is pulled downwardly, then the screws 35 are unthreaded through the holes 37 and the screw of the shell 51 is loosened and then the finishing plate 34 is disassembled from the finishing casing 1. Subsequently thereto, the screw 30 is removed and the sleeve 32 is removed from the crank pin 28' together with the two-roll ball bearing 21 seated therein. Thereafter, a sleeve 32 with a new ball bearing 29 therein is positioned on the crank pin 28' and the finishing power tool is reassembled following the above-enumerated steps in a reverse order.

It is also easy to exchange the V-belt 40 at the same time that the finishing plate 34 is disassembled from the casing, by removing the screw 45 from the output shaft 12 of the motor 10 and by removing the lower part 43 from the shaft 12, so that the V-belt 40 slides off the output shaft 12 and can be taken out of the recess 39' of the pulley 28. If necessary, it is possible to so select the thickness of the spacing disc 44 that a new or a partially worn out V-belt 40 is properly tensioned.

The construction of the sleeve 32 and of the finishing plate 34 as two separate components renders it possible not only to easily disassemble the power tool and thus simply exchange worn out or damaged components of the assembly, such as the ball bearing 29 and the V-belt 40, as discussed above, but also renders it possible to make the finishing plate 34 of a light material and the sleeve 32 of a heavy material. In this manner, the center of gravity of the oscillating body which includes the finishing plate 34 and the sleeve 32 can be relocated to such an extent in the upward direction that the counterweight 38 and the additional weight 39 which orbit about the sleeve 32 move in a plane which corresponds to the plane in which the center of gravity of the oscillating body is located. Therefore, an additional advantage obtained by this arrangement is an excellent quietness of operation of the finishing power tool.

It will be understood that each of the elements described above, or two or more together, may also find a useful application in other types of constructions differing from the types described above.

While the invention has been illustrated and described as embodied in a finishing power tool, it is not intended to be limited to the details shown since various modifications and structural changes may be made without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An oscillatory finishing tool comprising, in combination, a housing provided with a handle for the user of the finishing tool to hold while using the tool;

a crank mounted in the housing for rotation about a crank rotation axis and including an eccentric portion;

a drive motor accommodated in the housing and coupled to the crank for rotating the latter about the crank rotation axis;

a roller bearing unit encircling and engaging the eccentric portion of the crank;

a discrete annular sleeve of a material of relatively high specific weight encircling and engaging the roller-bearing unit;

a discrete support plate structure for supporting a sheet of sandpaper or the like, the support plate structure having a first face facing the annular sleeve and having a second face, the second face being an exposed face for supporting a sheet of sandpaper or the like in direct surface-to-surface contact with the second face;

the annular sleeve having at least one threaded axial mounting bore and the support plate structure having in correspondence thereto at least one axial mounting passage extending all the way through the support plate structure from the second to the first face thereof;

at least one mounting screw having a threaded shank extending through the mounting passage and threaded into the mounting bore of the annular sleeve and having a head pressing the first face of the support plate structure towards the annular sleeve, the head of the mounting screw being exposed to direct access for a screwdriver or the like when a sheet of sandpaper or the like is removed from the second face of the supporting plate structure, the support plate structure when removed from the tool exposing the annular sleeve and the roller-bearing unit for access and the support plate structure being made of a material of relatively low specific weight, whereby the center of gravity of the combination of the annular sleeve and the support plate structure is located in the vicinity of the annular sleeve and spaced a distance from the support plate structure.

2. A finishing tool as defined in claim 1, the mounting screw pressing the first face of the support plate structure into direct surface-to-surface contact with an axial end face of the annular sleeve.

3. A finishing tool as defined in claim 2, the first face of the support plate structure having a projecting portion which surrounds the annular sleeve so that the oscillatory movement performed by the sleeve during rotation of the crank is transmitted to the support plate structure from the sleeve to the projecting portion of the support plate structure, whereby the working force applied by the tool to a surface to be finished is not transmitted to the support plate structure via mounting-screw shearing forces.

4. A finishing tool as defined in claim 3, the projecting portion of the first face of the support plate structure being an annular projection which encircles and engages the peripheral surface of the annular sleeve.

5. A finishing tool as defined in claim 4, the roller-bearing unit being a ball-bearing unit comprising an inner race, an outer race and spherical bearings confined therebetween, the annular sleeve being force fit on the outer race.

6. A finishing tool as defined in claim 1, the roller-bearing unit being a ball-bearing unit comprising an inner race, an outer race and spherical bearings confined therebetween, the annular sleeve being force fit on the outer race.

7. A finishing tool as defined in claim 1, three of said mounting screws being provided, the annular sleeve being provided with three equiangularly spaced threaded mounting bores, and the support plate structure having in correspondence thereto three equiangularly spaced axial mounting passages.

8. A finishing tool as defined in claim 1, furthermore including a first pulley mounted on the crank in the vicinity of the roller-bearing unit, a second pulley mounted on the output shaft of the drive motor, the second pulley being bipartite and comprising two disk-like halves of which one can be removed from the other, and a drive belt trained about the two pulleys, the second pulley being exposed to access when the support plate structure is removed so that one half of the second pulley can be removed for drive belt replacement.

9. A finishing tool as defined in claim 8, the first pulley being provided with a counterweight.

10. A finishing tool as defined in claim 9, the removable half of the second pulley being mounted on the output shaft of the drive motor by a single mounting screw which when removed permits the removable pulley half to be immediately removed from the drive motor output shaft.

11. A finishing tool as defined in claim 10, furthermore including at least one spacing ring on the drive motor output shaft establishing the positions of the two halves of the second pulley.

12. A finishing tool as defined in claim 1, the support plate structure being made of light metal, the annular sleeve being made of steel.

13. A finishing tool as defined in claim 1, the crank with its eccentric portion being a one-piece member made of a single piece of material.

* * * * *